US005200588A

United States Patent [19]

Kondoh et al.

[11] Patent Number: 5,200,588

[45] Date of Patent: Apr. 6, 1993

[54] MICROWAVE HEATING APPARATUS HAVING IMPEDANCE MATCHING ADJUSTABLE WAVEGUIDE

[75] Inventors: Isao Kondoh; Yoshiyuki Kato, both of Naka, Japan

[73] Assignee: Doryokuro Kakunenryo Kaihatsu Jigyodan, Tokyo, Japan

[21] Appl. No.: 791,535

[22] Filed: Nov. 14, 1991

[30] Foreign Application Priority Data

Nov. 19, 1990 [JP] Japan ..... 2-313129

[51] Int. Cl.[5] ..... H05B 6/70

[52] U.S. Cl. ..... 219/10.55 A; 219/10.55 B; 219/10.55 F; 219/10.55 R; 219/10.55 M

[58] Field of Search ..... 219/10.55 B, 10.55 R, 219/10.55 F, 10.55 M, 10.55 A; 333/17.3, 253, 263

[56] References Cited

U.S. PATENT DOCUMENTS 3,474,212 10/1969 White ..... 333/253
4,711,983 12/1987 Gerling ..... 219/10.55 A
4,771,153 9/1988 Fukushima ..... 219/10.55 A
4,964,415 10/1990 Larsen ..... 219/10.55 F
5,008,506 4/1991 Asmussen et al. ..... 219/10.55 M
5,069,928 12/1991 Echizen et al. ..... 219/10.55 A

*Primary Examiner*—Bruce A. Reynolds
*Assistant Examiner*—Tuan Vinh To
*Attorney, Agent, or Firm*—Wenderoth, Lind & Ponack

[57] ABSTRACT

A microwave heating apparatus includes a microwave oscillator, a waveguide for transmitting microwave energy outputted from the microwave oscillator to an object to be heated, detectors for detecting the power of the microwave energy inputted from the microwave oscillator to the object to be heated and the reflected power of the microwave energy reflected from the object to be heated, a matching stub provided in the waveguide, and a driver for driving the matching stub. The driver calculates a VSWR value from the inputted power and the reflected power and includes a motor for driving the matching stub so that the VSWR value is maintained within a predetermined range. Matching of the waveguide impedance with the load impedance can be executed automatically and the VSWR value can be maintained in the range of good matching. Thus, lowering of heating efficiency can be prevented.

3 Claims, 2 Drawing Sheets

MICROWAVE HEATING APPARATUS HAVING IMPEDANCE MATCHING ADJUSTABLE WAVEGUIDE

BACKGROUND OF THE INVENTION

This invention relates to a microwave heating apparatus.

In the microwave heating apparatus, a microwave generated from microwave energy oscillator is applied through a waveguide to an object to be heated and the object is subjected to dielectric heating by the microwave.

When microwave energy heating is executed, the degree of absorption of the microwave in an object to be heated varies with time, such as with the reduction in the quantity of the object. Therefore, the load impedance varies and the voltage standing-wave ratio (VSWR value) in the waveguide changes, and consequently it becomes impossible to cause microwave energy from the waveguide to be absorbed efficiently in the object.

In order to prevent the lowering of efficiency due to the change in the VSWR value, it has been a usual practice that an operator adjusts manually a stub for adjustment provided in the waveguide, while watching the data denoting the incident and reflected power of the microwave energy in the waveguide, so as to vary the waveguide impedance appropriately for impedance matching and thereby to maintain the VSWR value within a predetermined range where favorable matching achieved.

However, such manual adjustment as stated above suffers the drawback of being troublesome and taking much time and labor, when the microwave heating continues for an especially long time or when the degree of absorption of the microwave energy in an object to be heated varies each heating.

To cope with this problem, there has been proposed a method wherein several kinds of expected variation patterns of the VSWR value are set beforehand on the basis of experience and properly selected in accordance with a change in the load impedance of the object, so as to vary the waveguide impedance and thereby to adjust the VSWR value.

By this method, however, the impedance matching can not be performed well and lowering of the heating efficiency is unavoidable when the VSWR value suddenly varies in an unexpected pattern other than the patterns prepared beforehand or when the selected variation pattern does not coincide with the actual change in the load impedance of the object to be heated.

SUMMARY OF THE INVENTION

An object of this invention is to provide a microwave heating apparatus which is free from the above-mentioned problems and which can vary the waveguide impedance automatically in accordance with the actual change in the load impedance of an object to be heated and adjust the VSWR value to within an optimum range and which, therefore, enables execution of microwave heating of high efficiency.

According to this invention, there is provided a microwave heating apparatus comprising a microwave oscillator, a waveguide for transmitting microwave energy outputted from the microwave oscillator to an object to be heated, means for detecting power provided in the waveguide so as to detect the power of the microwave energy inputted from the microwave oscillator to the object to be heated and the reflected power of the microwave reflected from the object to be heated, a matching stub provided in the waveguide, and means for driving the matching stub. The driving means is provided with means for calculating a VSWR value from the inputted power and the reflected power, a motor for driving the matching stub, and means for controlling the operation of the motor so that the VSWR value is maintained within a predetermined range.

Specifically for example, the VSWR value is calculated at all times from the input and reflected power of the microwave energy detected by an input wattmeter and a reflection wattmeter each connected to a directional coupler fitted to the waveguide. The motor is driven every time the VSWR value is out of the predetermined range set beforehand, and the matching stub connected to this motor is moved thereby along a X-axis (in the direction of the phase of the microwave in the waveguide) or along a Y-axis (in the direction of the susceptance of the microwave in the waveguide) so as to control the position from a load in the waveguide or the insertion length of the matching stub. Thus, a waveguide impedance is varied properly to attain impedance matching with a load impedance.

In more detail, the matching stub is driven and controlled in the following steps (1) and (2), for instance:

(1) When the VSWR value calculated from the input and reflected power of the microwave energy is out of a predetermined range (a range of excellent matching), the control stub is first moved along the X-axis to search for a point at which the VSWR value is the minimum;

(2) When the VSWR value can not be set in the predetermined range even by the adjustment according to the step (1), the matching stub is then moved along the Y-axis to vary the insertion length of the matching stub in the waveguide and, in this way, the VSWR value likewise adjusted to be the minimum.

In the case when the adjustment of step (1) stated above is executed, the insertion length along the Y-axis in relation to the VSWR value at the point to which the stub is moved in step (1) is calculated from a data table inputted beforehand to a computer and a control expected so that the matching stub be so moved along the Y-axis that the insertion length becomes equal to the calculated one.

In order to make the microwave energy from the microwave oscillator be absorbed efficiently in an object to be heated, a waveguide impedance needs to be matched (the VSWR value is 1) with a load impedance which varies with time.

By taking the above-stated procedure, the waveguide impedance can be put in the state of being matched with the load impedance.

Even when a sudden and sharp change occurs in the load impedance, impedance matching corresponding to this change is conducted automatically, the VSWR value can thereby be held within the range of excellent matching, and as a result, the lowering of the heating efficiency can be prevented.

Further, since all operations required for the impedance matching are automatically performed, all the operations by an operator are eliminated, and therefore the saving of labor can be achieved. Moreover, it is unnecessary to input beforehand the variation characteristic of the VSWR value of an object to be heated, and the requisite of experience is not necessary unlike the conventional cases.

PREFERRED EMBODIMENTS OF THE INVENTION

An embodiment of this invention will be described hereinbelow with reference to the attached drawings. In this embodiment, two systems of heating means each constructed of a microwave oscillator, a waveguide, etc. are provided.

Figure 1:
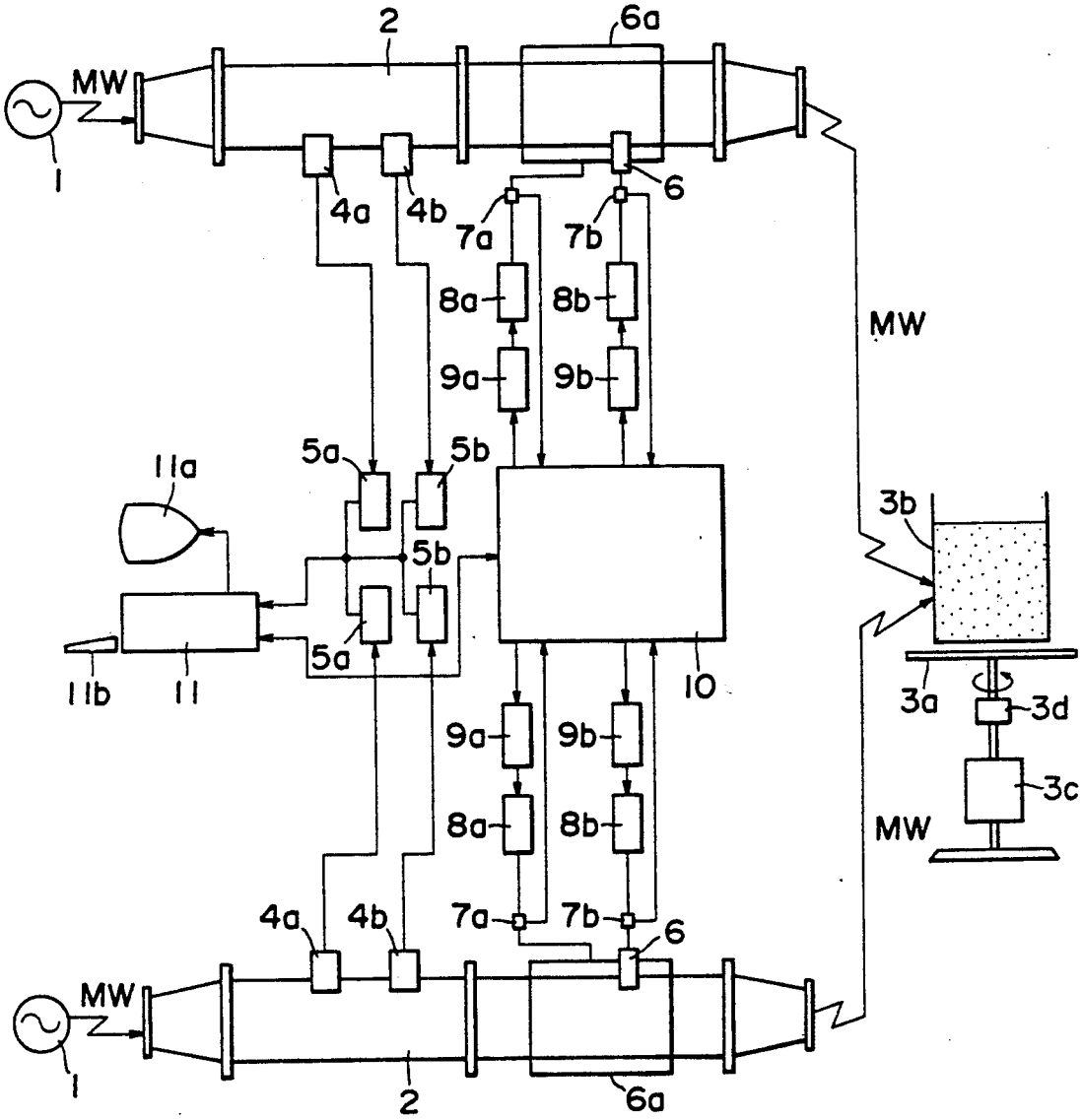
FIG. 1 is an explanatory view of a microwave heating apparatus according to an embodiment of this invention.

In a microwave heating apparatus of the embodiment shown in FIG. 1, a microwave MW generated from microwave energy oscillator 1 is applied through a waveguide 2 to a vessel 3*b* being set on a turntable 3*a* and containing an object to be heated. Part of the microwave energy MW applied is reflected from the object and returned into the waveguide 2. Symbol 3*c* denotes a motor for driving the turntable 3*a*, and 3*d* a sensor for detecting a rotational position.

To the left-side portion of the waveguide 2, a directional coupler 4*a* for detecting, inside the waveguide, the microwave inputted from the microwave oscillator I and a directional coupler 4*b* for detecting the reflected microwave mentioned above are fitted respectively. These directional couplers 4*a* and 4*b* are connected to an input wattmeter 5*a* and a reflection wattmeter 5*b* respectively. Values of input power and reflected power detected by the input wattmeter 5*a* and the reflection wattmeter 5*b* respectively are inputted into a computer 11 equipped with a display 11*a*, a keyboard 11*b*, etc.

In the right-side portion of the waveguide 2 shown in FIG. 1, on the other hand, a matching stub 6 fitted to a sliding tuner member 6*a* is provided.

Figure 2A:
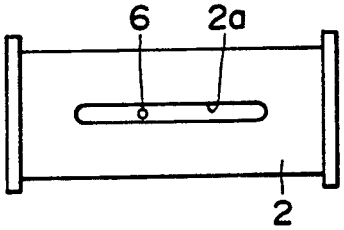
FIGS. 2A and 2B are explanatory views of a matching stub employed in the embodiment of this invention.
Figure 2B:
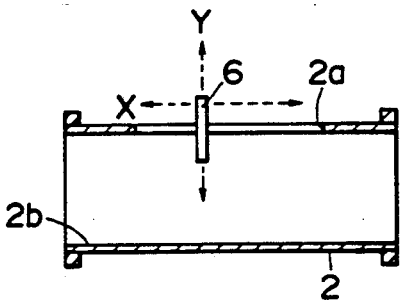

As is shown in FIGS. 2A and 2B, the matching stub 6 is movable in a vertical direction (the direction of the Y-axis) toward the inside 2*b* of the waveguide 2 from a long hole 2*a* made in a part of the waveguide 2 and is also movable in a lateral direction (the direction of the X-axis) by the width of the long hole 2*a*, that is, it moves in these directions of the X- and Y-axes together with the sliding tuner member 6*a*.

The sliding tuner member 6*a* and the matching stub 6 are connected with limiters 7*a* and 7*b* for limiting the ranges of movement thereof, pulse motors 8*a* and 8*b* for driving them in the direction of the X- or Y-axis, pulse motor drivers 9*a* and 9*b*, a pulse motor driver controller 10, etc.

By these components, the control of the movement of the matching stub 6 in a direction of the X- or Y-axis is executed according to an instruction from the computer 11 connected to the pulse motor driver controller 10. In the computer 11, a program necessary for executing each of processings or operations to be described in the following is stored.

Figure 3:
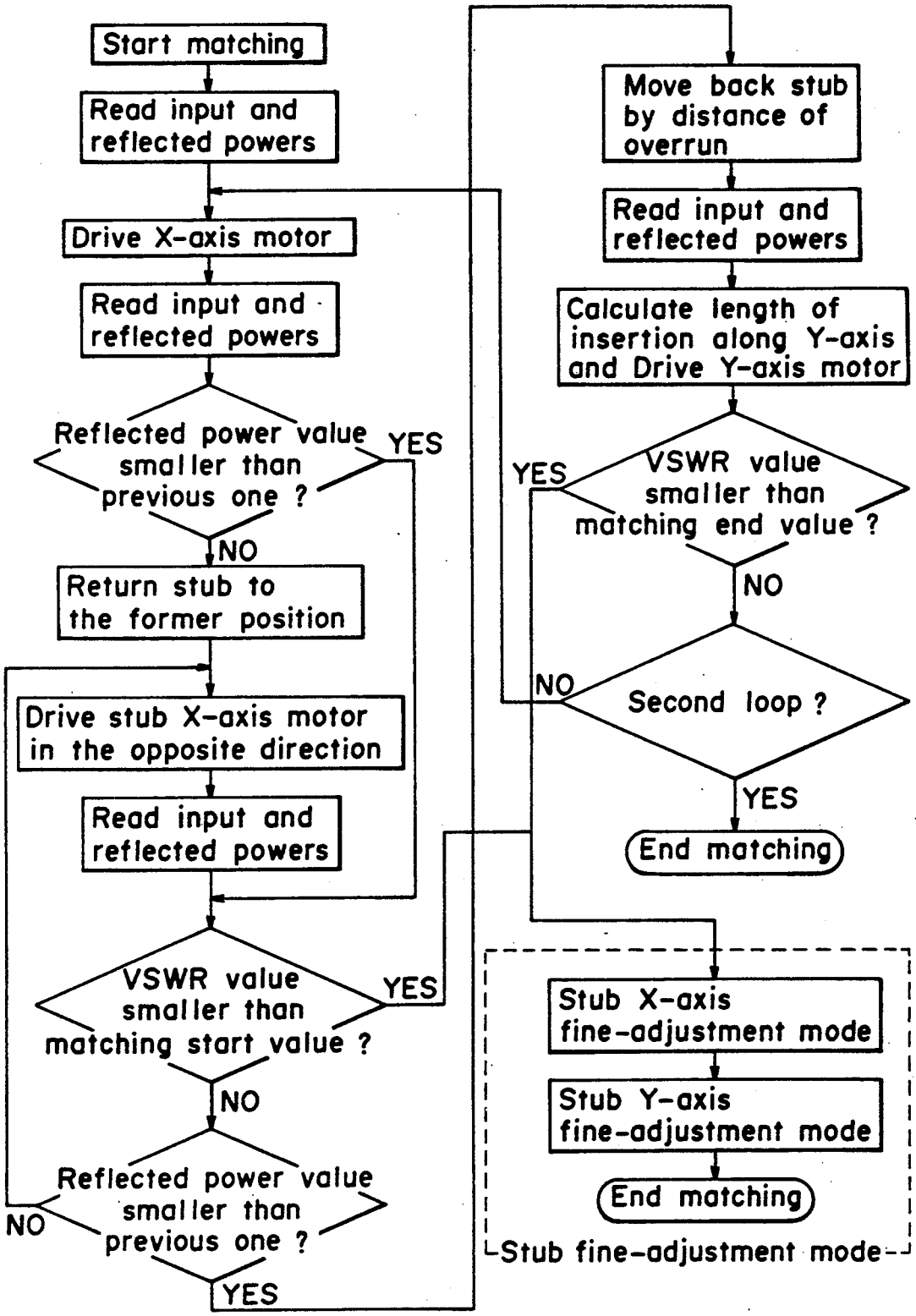
FIG. 3 is a flowchart for illustrating the operations conducted in the embodiment of this invention.

The matching operation in this embodiment having the above-described construction will be described hereinbelow with reference to FIG. 3.

First, predetermined values at a matching start and a matching end of the VSWR value are input and stored in the computer 11 using a keyboard or the like, and a range of excellent matching is set beforehand.

The microwave energy MW, is applied from the microwave oscillator 1 to the vessel 3*b* containing an object to be heated, through the waveguide 2. Then the input power value and the reflected power value of the microwave are read by the directional couplers 4*a* and 4*b* and the wattmeters 5*a* and 5*b* respectively. These power values are inputted to, the computer and the VSWR value is calculated from the following equations:

$$\mathrm{VSWR}=(1+\rho)/(1-\rho)$$

$\rho$ = reflected power/input power (where $\rho$ is a scalar quantity.)

Next, a drive signal is outputted from the computer 11 to the pulse motor 8*a* through the pulse motor driver controller 10 and the pulse motor driver 9*a*, and thereby the slider tuner member 6*a* and the matching stub 6 integrated with the member 6*a* are moved leftward or rightward along the X-axis. After the movement, a VSWR value is calculated from the input and reflected power values detected by the wattmeters 5*a* and 5*b*, in the same way as described above.

At this time the reflected power value after the movement and the reflected power value at the start of matching are compared with each other, and when the reflected power value after the movement is smaller, a comparison of the VSWR value after the movement with that at the start of matching is made.

When the reflected power value after the movement is larger, on the other hand, the matching stub 6 is driven reversely along the X-axis to a position beyond the original position according to an instruction from the computer 11. Then an VSWR value is calculated as described above from the input and reflected power values detected by the wattmeters 5*a* and 5*b* at this position, and next a comparison of this VSWR value with that at the start of matching is made.

When the result of this comparison shows that the VSWR value after the drive is smaller than that at the start of matching, a transfer is made to a stub fine-adjustment mode. This mode comprises a stub X-axis fine-adjustment mode and a stub Y-axis fine-adjustment mode.

In the stub X-axis fine-adjustment mode, the matching stub 6 is driven leftward or rightward along the X-axis little by little by a distance smaller than that described above, and the same operation as described above is executed. In the stub Y-axis fine-adjustment mode, the same adjustment as that in the direction of the Y-axis which will be described later is conducted by moving the matching stub 6 little by little upward or downward along the Y-axis. These operations are executed until the VSWR value changes to be below the above-mentioned value at the matching end.

When the result of the above-stated comparison of the VSWR values after the drive shows that the VSWR value is the same as or above that at the start of matching, on the other hand, a comparison between the reflected power values is made. When the reflected power value is the same as or above that at the start of matching, the loop is returned to a "drive of the stub X-axis motor in the opposite direction".

When the reflected power value is smaller than that at the start of matching, the matching stub 6 is moved back by a distance of the overrun along the X-axis to the position at the start of matching, and the VSWR value is calculated from the input and reflected power values read at this position.

Based on this VSWR value and on the stub Y-axis characteristic (the characteristic of VSWR in relation to the insertion length of the stub) contained in a data table which is stored beforehand in the computer 11, the length of insertion along the Y-axis of the matching stub 6 at the current position along the X-axis is computed and the matching stub 6 is moved downward or upward along the Y-axis so that it may become the calculated length.

When the VSWR value calculated from the input and reflected power value in the position after this movement is smaller than that at the start of matching, the same stub fine-adjustment mode as mentioned above is executed.

In the case when the VSWR value is the same as or larger than that at the start of matching, it is judged whether the loop is the second one or not, and the same matching operations are conducted again when it is the first one (NO), while the matching operation in a series are ended when it is the second one (YES).

When matching of one system is completed in the manner as described above, matching of the other system is conducted likewise.

As is understood from the foregoing, according to the microwave heating apparatus of this invention, matching of the waveguide impedance with the load impedance can be executed automatically and the VSWR value can be maintained in the range of good matching. Therefore, the lowering of heating efficiency can be prevented.

Since all the operations are automatically preformed and all the operations by operators are eliminated, the saving of labor and other advantages can be achieved.

While this invention has been described with respect to a preferred embodiment, it should be apparent to those skilled in the art that numerous modifications may be made thereto without departing from the scope of the invention.

What is claimed is:

1. A microwave heating apparatus comprising:

a microwave oscillator, a waveguide for transmitting a microwave outputted from the microwave oscillator to an object to be heated, means for detecting power provided in the waveguide so as to detect the power of the microwave inputted from the microwave oscillator to the object to be heated and the reflected power of the microwave reflected from the object to be heated, a matching stub provided in the waveguide, and means for driving the matching stub, said driving means being provided with means for calculating a VSWR value from the inputted power and the reflected power, a motor for driving the matching stub, and means for controlling the operation of the motor so that the VSWR value is maintained within a predetermined range.

2. The microwave heating apparatus according to claim 1, wherein said means for detecting power comprises an input wattmeter connected to a directional coupler for detecting the inputted power of the microwave and a reflection wattmeter connected to a directional coupler for detecting the reflected power of the microwave, both of said directional couplers being fitted to the waveguide.

3. The microwave heating apparatus according to claim 1, wherein said motor comprises a motor for driving the matching stub in an X-axis direction which is coincident with the direction of the phase of the microwave in the waveguide and a motor for driving the matching stub in a Y-axis direction which is coincident with the direction of the susceptance of the microwave in the waveguide, the operation of each of said motors being separately controlled by said controlling means.

* * * * *